US009850622B1

(12) United States Patent
Lavernia

(10) Patent No.: US 9,850,622 B1
(45) Date of Patent: Dec. 26, 2017

(54) FRONT-LOADING LAUNDRY BASKET

(71) Applicant: Henry Lavernia, Boca Raton, FL (US)

(72) Inventor: Henry Lavernia, Boca Raton, FL (US)

( * ) Notice: Subject to any disclaimer, the term of this patent is extended or adjusted under 35 U.S.C. 154(b) by 0 days.

(21) Appl. No.: 15/263,697

(22) Filed: Sep. 13, 2016

(51) Int. Cl.
*D06F 95/00* (2006.01)
*B65D 37/00* (2006.01)

(52) U.S. Cl.
CPC ..... *D06F 95/004* (2013.01); *B65D 37/00* (2013.01)

(58) Field of Classification Search
CPC .... D06F 95/006; D06F 95/004; D06F 95/002; B65D 37/00; B65D 11/28
USPC ..... 220/9.1, 9.3, 9.2, 482, 480, 476; D32/6, D32/36, 67; 248/692, 690, 306, 312.1, 248/311.2, 309.1, 304; 34/90, 104, 201
See application file for complete search history.

(56) References Cited

U.S. PATENT DOCUMENTS 1,284,579 A * 11/1918 Brown ..... B65D 7/20 220/482
1,521,414 A * 12/1924 Arcaro ..... D06F 95/002 220/23.4
2,227,702 A 1/1941 Castleberry
2,685,441 A * 8/1954 Baade ..... D06F 95/002 177/126
2,904,897 A * 9/1959 Whyte ..... D06F 95/004 34/90
4,091,548 A * 5/1978 Daily ..... D06F 58/04 312/311
5,276,979 A * 1/1994 Gordon, Sr. ..... D06F 58/04 34/109
D533,327 S 12/2006 McCaskill
7,228,646 B1 * 6/2007 Purcell ..... D06F 58/04 34/104
8,602,423 B1 12/2013 Alexander
2006/0208439 A1 9/2006 DePasquale
2007/0061962 A1 3/2007 Pascual
2007/0183691 A1 8/2007 Finnegan

FOREIGN PATENT DOCUMENTS

DE 4034660 A1 * 5/1992 ..... D06F 58/04

* cited by examiner

*Primary Examiner* — Robert J Hicks
(74) *Attorney, Agent, or Firm* — Kyle A. Fletcher, Esq.

(57) ABSTRACT

The front-loading laundry basket is adapted for use with a front-loading washing machine. The front-loading laundry basket is adapted for use with a dryer. The front-loading laundry basket is adapted for use with a laundry basket. The front-loading washing machine is further defined with a first circular door. The front-loading dryer is further defined with a second circular door. The front-loading laundry basket is an accessory that attaches the laundry basket to a circular door selected from the group consisting of the first circular door or the second circular door. The front-loading laundry basket comprises a laundry basket and a bracket. The bracket attaches the laundry basket to the circular door selected from the group consisting of the first circular door or the second circular door.

19 Claims, 4 Drawing Sheets

FRONT-LOADING LAUNDRY BASKET

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of laundering systems and other arrangements of apparatus for textiles, more specifically, a basket or bag adapted for holding or transporting laundry.

SUMMARY OF INVENTION

The front-loading laundry basket is adapted for use with a front-loading washing machine. The front-loading laundry basket is adapted for use with a dryer. The front-loading laundry basket is adapted for use with a laundry basket. The front-loading washing machine is further defined with a first circular door. The front-loading dryer is further defined with a second circular door. The front-loading laundry basket is an accessory that attaches the laundry basket to a circular door selected from the group consisting of the first circular door or the second circular door.

These together with additional objects, features and advantages of the front-loading laundry basket will be readily apparent to those of ordinary skill in the art upon reading the following detailed description of the presently preferred, but nonetheless illustrative, embodiments when taken in conjunction with the accompanying drawings.

In this respect, before explaining the current embodiments of the front-loading laundry basket in detail, it is to be understood that the front-loading laundry basket is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the front-loading laundry basket.

It is therefore important that the claims be regarded as including such equivalent construction insofar as they do not depart from the spirit and scope of the front-loading laundry basket. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention.

They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
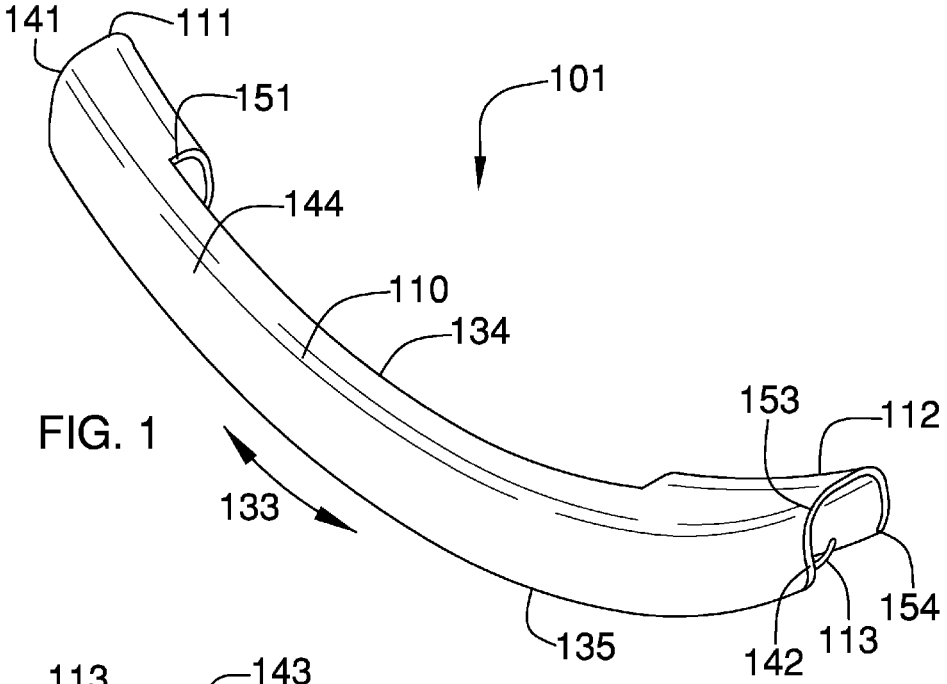
FIG. 1 is a perspective view of an embodiment of the disclosure.
Figure 2:
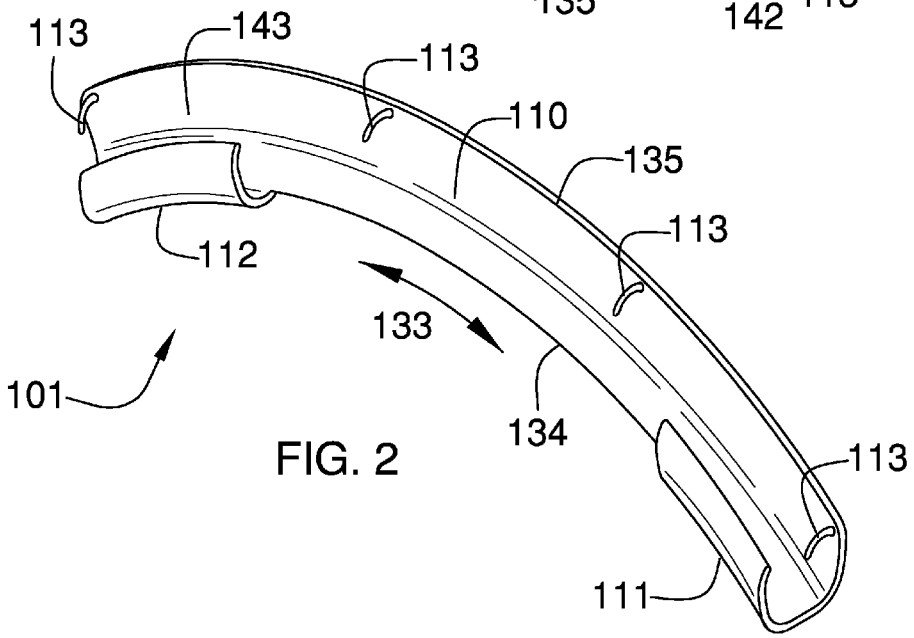
FIG. 2 is a perspective view of an embodiment of the disclosure.
Figure 3:
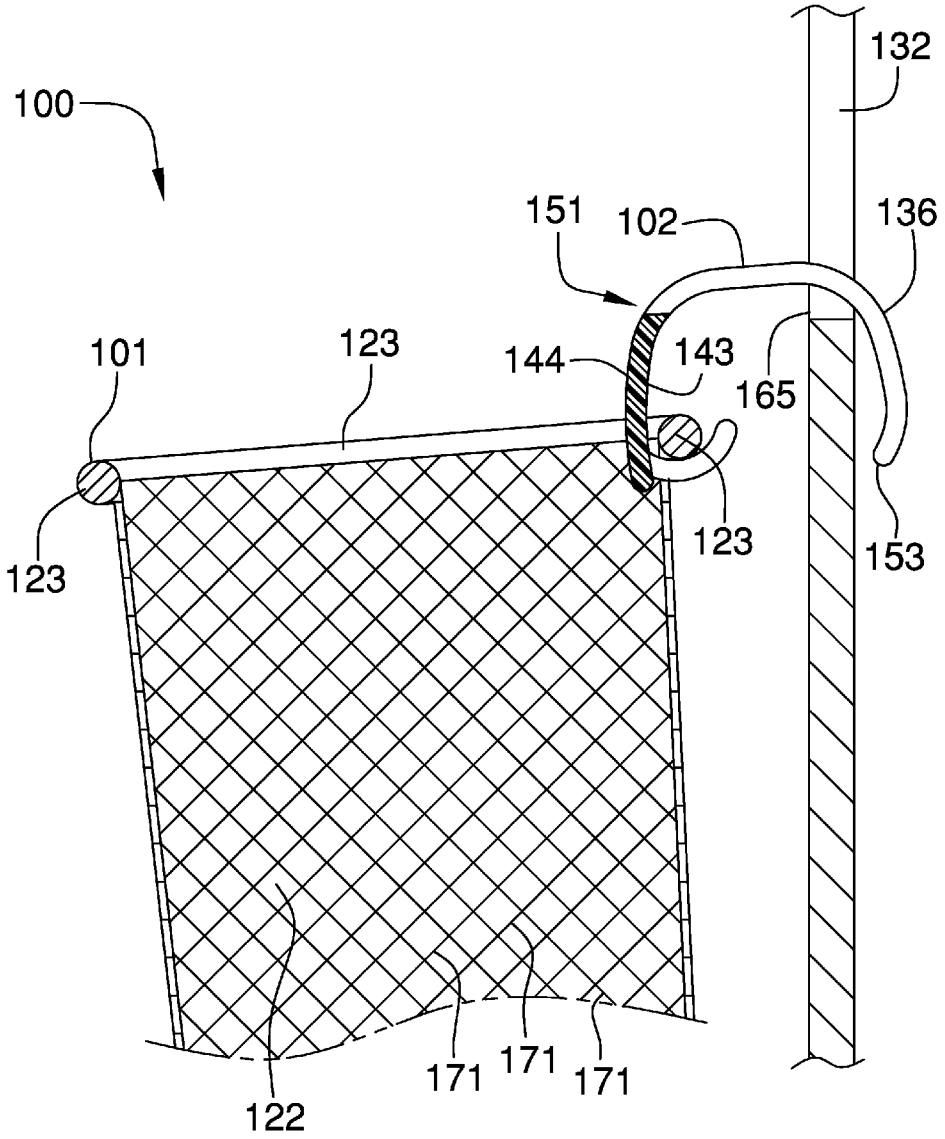
FIG. 3 is a cross-sectional view of an embodiment of the disclosure across 3-3 as shown in FIGS. 1 and 5.
Figure 4:
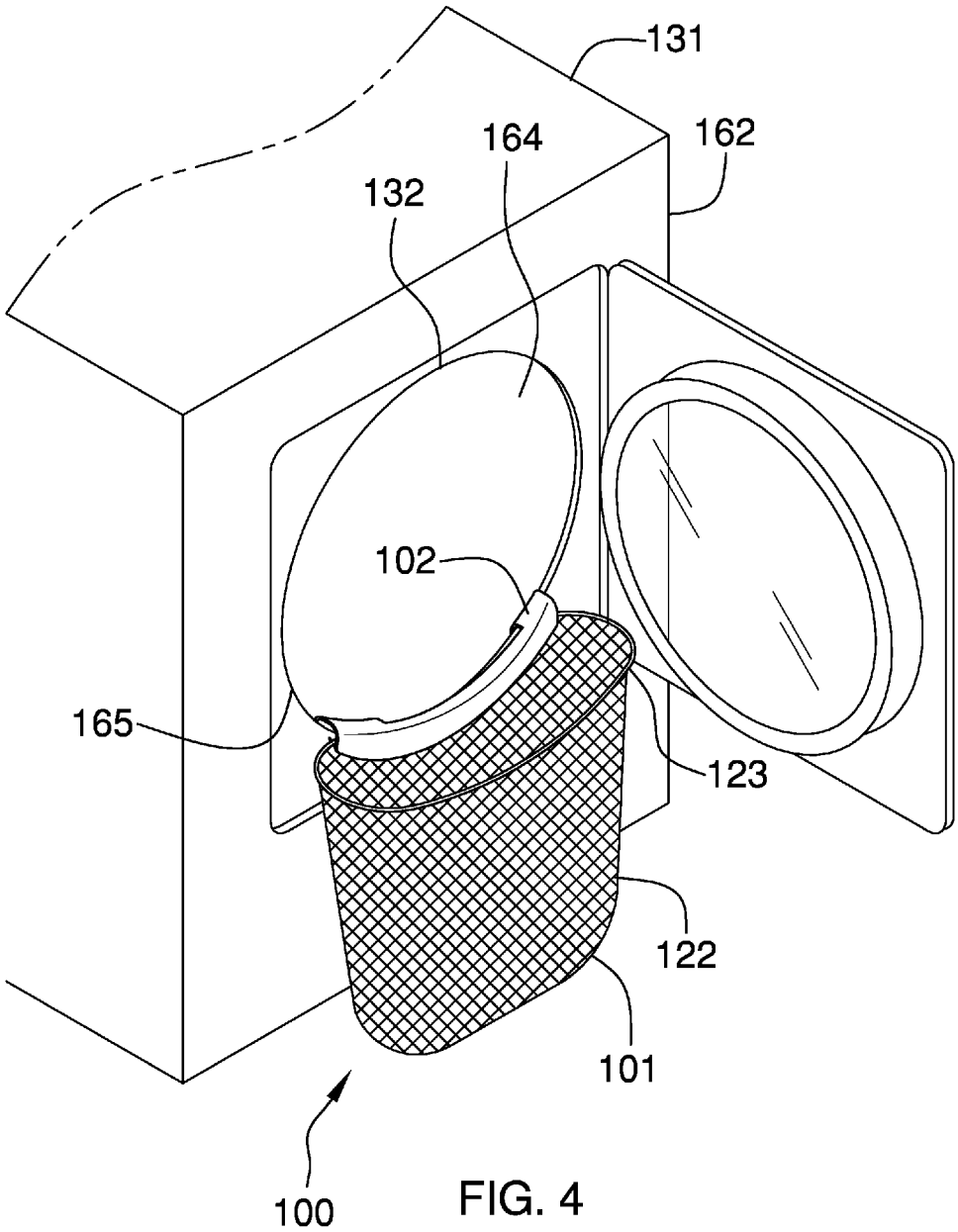
FIG. 4 is an in use view of an embodiment of the disclosure.
Figure 5:
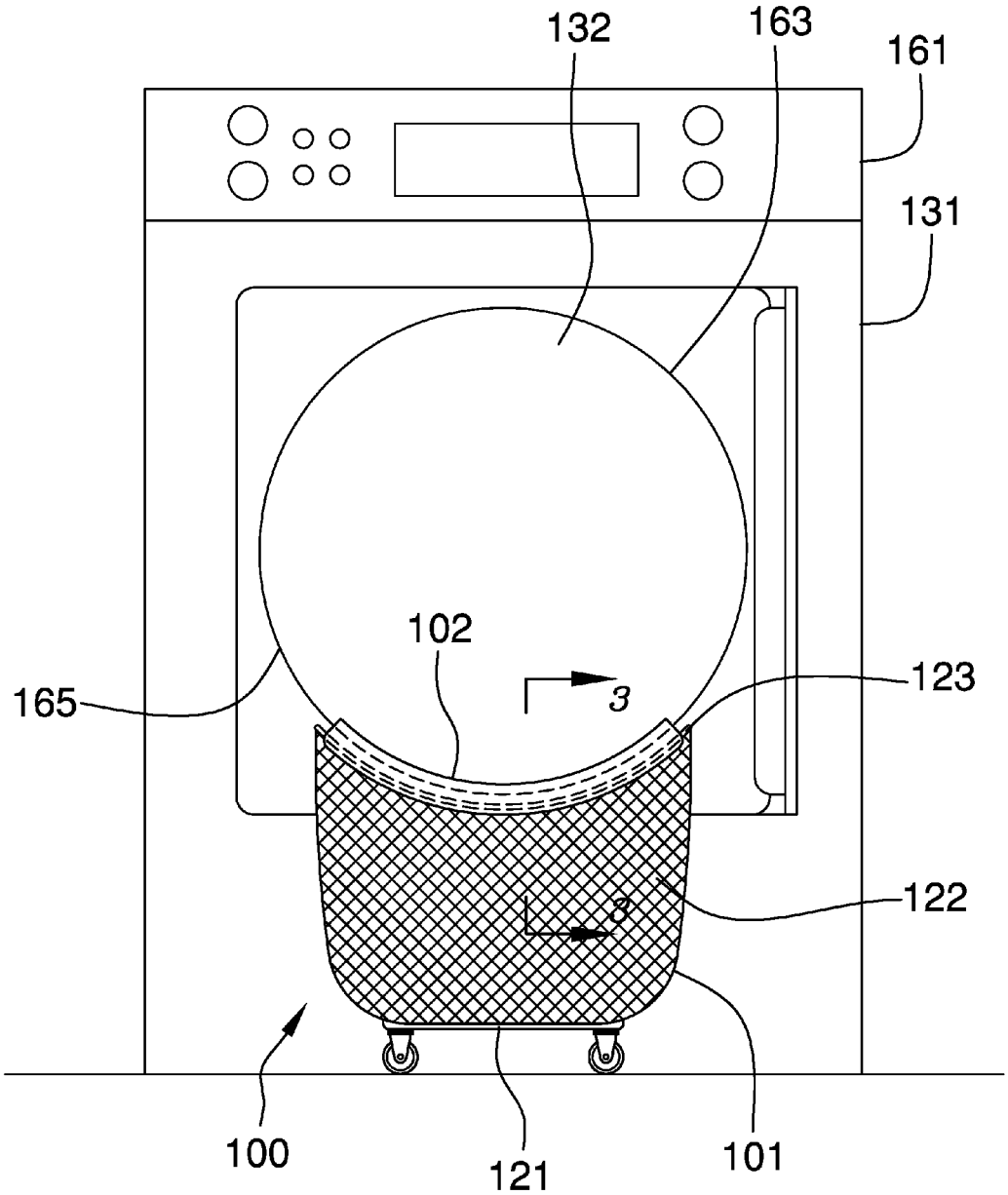
FIG. 5 is an in use view of an alternate embodiment of the disclosure.

Detailed reference will now be made to one or more potential embodiments of the disclosure, which are illustrated in FIGS. 1 through 5.

The front-loading laundry basket 100 (hereinafter invention) comprises a laundry basket 101 and a bracket 102. The bracket 102 attaches the laundry basket 101 to the circular door 132 selected from the group consisting of the first circular door 163 or the second circular door 164. The invention 100 is adapted for use with a front-loading washing machine 161. The invention 100 is adapted for use with a front-loading dryer 162. The front-loading washing machine 161 is further defined with a first circular door 163. The front-loading dryer 162 is further defined with a second circular door 164. The bracket 102 attaches the laundry basket 101 to a circular door 132 selected from the group consisting of the first circular door 163 or the second circular door 164.

The specification and claims of this disclosure will hereinafter implicitly assume the first circular door 163 of the front-loading washing machine 161 and the second circular door 164 of the front-loading dryer 162 are identical. This is done for the purposes of simplicity and for clarity of exposition of the disclosure is not intended to limit the scope of the appended claims. Those skilled in the art will recognize that the innovations described in this disclosure can be readily modified to accommodate differences in size or shape between the first circular door 163 and the second circular door 164 with a minimum of modification and experimentation. Throughout the disclosure, the use of the term "circular door" 132 will be used to refer to either the first circular door 163 or the second circular door 164. For similar reasons, the use of the term machine 131 will be used to refer to either the front-loading washing machine 161 or the front-loading dryer 162.

The bracket 102 comprises a brace 110, a first clip 111, a second clip 112, and a plurality of net hooks 113. The first clip 111, the second clip 112, and the plurality of net hooks 113 are attached to the brace 110. The brace 110 is further defined with a first end 141, a second end 142, a first surface 143, and a second surface 144. The brace 110 is a curved panel that is formed in a Euclidian plane. The curvature of the brace 110 is a circular arc 133. The radius of circle that forms the circular arc 133 is selected such that: 1) the outer radius 135 of the circular arc 133 is greater than the radius of the circle that forms the circular door 132; and, 2) the inner radius 134 of the circular arc 133 is equal to or greater than the radius of the circle that forms the circular door 132.

The first clip 111 is an L shaped structure that attaches to the brace 110. The first clip 111 is further defined with a first edge 151 and a second edge 152. The first edge 151 of the first clip 111 attaches to the inner radius 134 at the first end 141. The first clip 111 projects away from the first surface 143 in a direction away from the second surface 144. The curvature of the first clip 111 is such that the first clip 111 will match the curvature of the brace 110 to form a smooth surface. As shown most clearly in FIG. 3, the first clip 111 forms a hook 136 that is placed over the circumference 165 of the circular door 132 such that the bracket 102 will hang from the circular door 132.

The second clip 112 is an L shaped structure that attaches to the brace 110. The second clip 112 is further defined with a third edge 153 and a fourth edge 154. The third edge 153 of the second clip 112 attaches to the inner radius 134 at the second end 142. The second clip 112 projects away from the first surface 143 in a direction away from the second surface 144. The curvature of the second clip 112 is such that the second clip 112 will match the curvature of the brace 110 to form a smooth surface. As shown most clearly in FIG. 3, the second clip 112 forms a hook 136 that is placed over the circumference 165 of the circular door 132 such that the bracket 102 will hang from the circular door 132.

The plurality of net hooks 113 is a collection of hooks that are used to attach the laundry basket 101 to the bracket 102. Each of the plurality of net hooks 113 is adapted to capture a loop selected from the plurality of mesh surfaces 122. Specifically, a loop from the plurality of mesh surfaces 122 is looped around the plurality of net hooks 113 such that the laundry basket 101 is attached and supported by the bracket 102 when the bracket 102 is suspended from the circular door 132.

The laundry basket 101 further comprises a plurality of mesh surfaces 122 and a frame 123. The plurality of mesh surfaces 122 is formed from one or more mesh textiles. The plurality of mesh surfaces 122 are attached to a frame 123. The frame 123 supports the plurality of mesh surfaces 122 such that a container suitable for holding apparel and textiles is formed. Laundry baskets 101 such as those described in the previous three sentences are readily and commercially available. It is preferred that the container formed by the laundry basket 101 be cylindrical in shape.

In a second potential embodiment of the disclosure, the frame 123 further comprises spring-like properties that allows the laundry basket 101 to be collapsed into a flat structure for storage. Laundry baskets 101 such as those described in the previous sentence are readily and commercially available and commonly marketed as pop-up laundry baskets or pop-up laundry hampers.

In a third potential embodiment of the disclosure, each of the one or more mesh textiles are formed from yarns 171 formed from one or more synthetic polymer fibers. Suitable fibers include, but are not limited to, polyester, polypropylene, or nylon. The use of a monofilament yarn 171 would be preferred for water resistance purposes.

In a fourth potential embodiment of the disclosure, each of the one or more mesh textiles is treated with an antimicrobial agent. The antimicrobial agent is selected from the group consisting of: 1) a impregnation of the polymer that forms the yarns 171 that form the one or more mesh textiles with silver nanoparticles; 2) the application of 5-chloro-2-(2,4-dichlorophenoxy)-phenol to the one or more textile meshes as a textile finish; or 3) the application of a quaternary ammonium based chemical to the one or more textile meshes as a textile finish.

In a fifth potential embodiment of the disclosure, each of the one or more mesh textiles is treated with perfluorobutanesulfonic acid to enhance water resistance of the yarns 171 comprising the one or more mesh textiles.

In a sixth potential embodiment of the disclosure, the laundry basket 101 is attached to a readily and commercially available dolly 121 that allows the laundry basket 101 to be readily transported between the washing machine 161 and the dryer 162.

To use the invention 100, the plurality of mesh surfaces 122 are looped around the plurality of net hooks 113 to attach the laundry basket 101 to the bracket 102. The bracket 102 is then hung from the circumference 165 of the circular door 132 of the machine 131 by hooking the first clip 111 and the second clip 112 around the circumference 165 of the circular door 132. The laundry basket 101 is then used normally.

In the first potential embodiment of the disclosure, the bracket 102 is formed as a single unit from molded plastic. Suitable plastics include, but are not limited to, polyethylene, polypropylene, or polyvinylchloride.

The following definitions were used in this disclosure:

5-chloro-2-(2,4-dichlorophenoxy)-phenol: As used in this disclosure, 5-chloro-2-(2,4-dichlorophenoxy)-phenol (CAS 3380-34-5) is an antifungal and antibiotic agent that is commonly used in consumer products. 5-chloro-2-(2,4-dichlorophenoxy)-phenol is commonly referred to as triclosan.

Colloidal Silver: As used in this disclosure, colloidal silver is a colloidal suspension of silver particles that are dissolved or dispersed in water. This definition does not preclude other materials that may dissolved or otherwise dispersed in the water with the colloidal silver.

Dolly: As used in this disclosure, a dolly refers to a mobile platform, generally mounted on casters, that is used to move a load or an object.

Fiber: As used in this disclosure, a fiber is a slender elongated structure.

Hook: As used in this disclosure, a hook is an object that is curved or bent at an angle such that items can be hung on or caught by the object.

Loop: As used in this disclosure, a loop is the length of a first linear structure including, but not limited to, lines, cords, or ribbons, that is: 1) folded over and joined at the ends forming an enclosed space; or, 2) curved to form a closed or nearly closed space within the first linear structure. In both cases, the space formed within the first linear structure is such that a second linear structure such as a line, cord or a hook can be inserted through the space formed within the first linear structure. Within this disclosure, the first linear structure is said to be looped around the second linear structure.

Mesh: As used in this disclosure, the term mesh refers to an openwork fabric made from threads, yarns, cords, wires, or lines that are woven, knotted, or otherwise twisted or intertwined at regular intervals. Synonyms for mesh include net.

Perfluorobutanesulfonic acid: As used in this disclosure, perfluorobutanesulfonic acid (CAS 375-73-5) is a surfactant, technically a fluorosurfactant, which is commonly applied to a textile as a water repellant.

Perimeter: As used in this disclosure, a perimeter is one or more curved or straight lines that bounds an enclosed area on a plane or surface. The perimeter of a circle is commonly referred to as a circumference.

Quaternary Ammonium: As used in this disclosure, quaternary ammonium is a positively charged molecule (cation) with a chemical structure $NR_4^+$. Unless otherwise stated, the R is assumed to be alkyl or aryl group molecule.

Spring: As used in this disclosure, a spring is a device that is used to store mechanical energy. This mechanical energy will often be stored by: 1) deforming an elastomeric material that is used to make the device; 2) the application of a torque to a rigid structure; or 3) a combination of the previous two items.

Textile: As used in this disclosure, a textile is a material that is woven, knitted, braided or felted. Synonyms in common usage for this definition include fabric and cloth.

Yarn: As used in this disclosure, a yarn is continuous strand of textile fibers and filaments. Yarns are generally used in the production of fabrics. For the purposes of this disclosure, this definition explicitly includes yarns formed from a single filament such as a monofilament yarn.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A basket and accessory comprising:
a laundry basket and a bracket;
wherein the basket and accessory is adapted for use with a front-loading washing machine;
wherein the basket and accessory is adapted for use with a front-loading dryer;
wherein the front-loading washing machine is adapted to be further defined with a first circular door;
wherein the front-loading dryer is adapted to be further defined with a second circular door;
wherein the bracket is adapted to attach the laundry basket to the circular door selected from the group consisting of the first circular door and the second circular door;
wherein a circular door is selected from the group consisting of the first circular door and the second circular door;
wherein a machine is adapted to be selected from the group consisting of the front-loading washing machine or the front-loading dryer;
wherein the bracket comprises a brace, a first clip, a second clip, and a plurality of net hooks;
wherein the first clip, the second clip, and the plurality of net hooks are attached to the brace;
wherein the brace is further defined with a first end, a second end, a first surface, and a second surface; wherein the brace is a curved panel that is formed in a Euclidian plane.

2. The basket and accessory according to claim 1
wherein the curvature of the brace is a circular arc;
wherein the circular arc is further defined with an inner radius;
wherein the circular arc is further defined with an outer radius.

3. The basket and accessory according to claim 2
wherein the radius of circle that forms the circular arc is selected such that the outer radius of the circular arc is greater than the radius of the circle that forms the circular door;
wherein the radius of circle that forms the circular arc is selected such that the inner radius of the circular arc is equal to or greater than the radius of the circle that forms the circular door.

4. The basket and accessory according to claim 3
wherein the first clip is an L shaped structure that attaches to the brace;
wherein the first clip is further defined with a first edge and a second edge.

5. The basket and accessory according to claim 4
wherein the first edge of the first clip attaches to the inner radius;
wherein the first clip projects away from the first surface in a direction away from the second surface.

6. The basket and accessory according to claim 5 wherein the first clip forms a hook that is placed over the circumference of the circular door such that the bracket will hang from the circular door.

7. The basket and accessory according to claim 6
wherein the second clip is an L shaped structure that attaches to the brace;
wherein the second clip is further defined with a third edge and a fourth edge.

8. The basket and accessory according to claim 7
wherein the third edge of the second clip attaches to the inner radius;
wherein the second clip projects away from the first surface in a direction away from the second surface.

9. The basket and accessory according to claim 8 wherein the second clip forms a hook that is placed over the circumference of the circular door such that the bracket will hang from the circular door.

10. The basket and accessory according to claim 9 wherein the
wherein the first clip attaches to the first end of the brace;
wherein the second clip attaches to the second end of the brace.

11. The basket and accessory according to claim 10 wherein the plurality of net hooks are a collection of hooks that are used to attach the laundry basket to the bracket.

12. The basket and accessory according to claim 11
wherein the laundry basket further comprises a plurality of mesh surfaces and a frame;
wherein the plurality of mesh surfaces are attached to the frame;

wherein the frame supports the plurality of mesh surfaces such that a container suitable for holding apparel and textiles is formed;

wherein the plurality of mesh surfaces is formed from one or more mesh textiles;

wherein each of the one or more mesh textiles are formed from yarns formed from one or more synthetic polymer fibers;

wherein the container formed by the laundry basket is cylindrical in shape.

13. The basket and accessory according to claim 12 wherein frame collapses into a flat structure for storage.

14. The basket and accessory according to claim 13 wherein in each of the one or more mesh textiles is treated with an antimicrobial agent.

15. The basket and accessory according to claim 14 wherein the antimicrobial agent is selected from the group consisting of: 1) a impregnation of the polymer that forms the yarns that form the one or more mesh textiles with silver nanoparticles; 2) the application of 5-chloro-2-(2,4-dichlorophenoxy)-phenol to the one or more textile meshes as a textile finish; or 3) the application of a quaternary ammonium based chemical to the one or more textile meshes as a textile finish.

16. The basket and accessory according to claim 15 wherein each of the one or more mesh textiles is treated with perfluorobutanesulfonic acid.

17. The basket and accessory according to claim 16 wherein the laundry basket further comprises a dolly.

18. The basket and accessory according to claim 17 wherein each of the plurality of net hooks is adapted to capture a loop selected from the plurality of mesh surfaces;

wherein loop selected from the plurality of mesh surfaces is looped around the plurality of net hooks such that the laundry basket is attached and supported by the bracket when the bracket is suspended from the circular door.

19. The basket and accessory according to claim 18 wherein the yarns formed from synthetic polymer fibers are monofilament yarns.

* * * * *